US007455550B1

(12) United States Patent
Sykes

(10) Patent No.: US 7,455,550 B1
(45) Date of Patent: Nov. 25, 2008

(54) SNAP-ON COAXIAL PLUG

(75) Inventor: Michael Timothy Sykes, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/029,837

(22) Filed: Feb. 12, 2008

(51) Int. Cl.
*H01R 9/05* (2006.01)

(52) U.S. Cl. ..... 439/584; 439/578

(58) Field of Classification Search ..... 439/583, 439/584, 578
See application file for complete search history.

(56) References Cited

U.S. PATENT DOCUMENTS 4,655,534 A 4/1987 Stursa
5,181,861 A 1/1993 Gaver, Jr. et al.
5,316,494 A * 5/1994 Flanagan et al. ..... 439/578
5,435,745 A * 7/1995 Booth ..... 439/583
5,595,499 A 1/1997 Zander et al.
5,620,339 A * 4/1997 Gray et al. ..... 439/584
6,146,196 A * 11/2000 Burger et al. ..... 439/578
6,361,348 B1 3/2002 Hall et al.
6,450,829 B1 9/2002 Weisz-Margulescu
6,645,011 B2 11/2003 Schneider et al.
6,808,415 B1 * 10/2004 Montena ..... 439/584

* cited by examiner

*Primary Examiner*—Briggitte R Hammond

(57) ABSTRACT

A plug component for use with coaxial connector systems having a plug component and a threaded jack component is provided. This plug component includes a first electrical contact; a second electrical contact positioned around the first electrical contact, wherein the second electrical contact further includes a plurality of outwardly-biased protrusions; a body positioned around the second electrical contact, wherein the body is adapted to receive the outwardly-biased protrusions formed on the second electrical contact and form a ground plane therewith; at least one biasing member positioned around the body, wherein the biasing member provides linear force sufficient to urge the second electrical contact against a jack component for maintaining a ground plane therewith; and a locking device positioned around the biasing member and the body, wherein the locking device is adapted to mechanically engage the threaded area on the jack component for attaching the plug component to the jack component.

20 Claims, 8 Drawing Sheets

SNAP-ON COAXIAL PLUG

BACKGROUND OF THE INVENTION

The described invention relates in general to connector systems for use with electronic devices, and more specifically to an improved plug for use with connector systems of the type commonly used to join cables together.

The Type N connector is a threaded connector used to join coaxial cables to one another. This connector was originally developed to provide a durable, weatherproof, medium-size radio frequency (RF) connector having consistent performance through 11 GHz and was one of the first connectors capable of carrying microwave-frequency signals. Currently, there are two basic families of Type N connectors: (i) the standard N (coaxial cable); and (ii) the corrugated N (helical and annular cable). The primary applications for these connectors are the termination of medium to miniature size coaxial cable, including RG-8, RG-58, RG-141, and RG-225. The N connector follows the MIL-C-39012 standard, defined by the US military, and comes in 50 and 75 ohm versions, the latter of which is used in the cable television industry. RF coaxial connectors are often considered to be the most important element in the "cable" system.

Current Type N connector systems include two basic components: a plug that utilizes a center pin (i.e., male gender); and a jack that utilizes a center socket (i.e., female gender), to which the plug is connected. Connecting these components to one another involves turning a collar included on the plug to engage threading included on the jack. Turning the collar typically involves the use of a somewhat unwieldy torque wrench. This wrench tightens the collar to a specific, predetermined torque value for ensuring that the ground plane has a proper connection. Because the use of the torque wrench is inconvenient, and may damage the plug if the wrench is improperly used, there is an ongoing need for an N connector system that does not require the use of a wrench.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a connector system for use with coaxial cable is provided. This system includes a jack component and a plug component. The jack component further includes a first electrical contact; and a body for housing the first electrical contact, wherein the body further comprises a threaded area formed thereon. The plug component further includes: a second electrical contact adapted to engage the first electrical contact and establish a signal plane therewith; a third electrical contact circumferentially disposed around at least a portion of the second electrical contact, wherein the third electrical contact further includes a plurality of outwardly-biased protrusions formed at one end thereof; a body circumferentially disposed around at least a portion of the third electrical contact, wherein the body is adapted to receive the outwardly-biased protrusions formed on the third electrical contact and form a ground plane therewith; at least one biasing member circumferentially disposed around the body, wherein the at least one biasing member provides axial force sufficient to urge the third electrical contact against the body of the jack component for forming a ground plane therewith; and a locking device circumferentially disposed around the biasing member and the body. A portion of the locking device is adapted to mechanically engage the threaded area on the jack component for securely attaching the plug component to the jack component.

In accordance with another aspect of the present invention, a plug component for use with connector systems having a plug component and a threaded jack component is provided. This plug component includes a first electrical contact; a second electrical contact positioned around the first electrical contact, wherein the second electrical contact further includes a plurality of outwardly-biased protrusions; a body positioned around the second electrical contact, wherein the body is adapted to receive the outwardly-biased protrusions formed on the second electrical contact and form a ground plane therewith; at least one biasing member positioned around the body, wherein the biasing member provides linear force sufficient to urge the second electrical contact against a jack component for maintaining a ground plane therewith; and a locking device positioned around the biasing member and the body, wherein the locking device is adapted to mechanically engage the threaded area on the jack component for attaching the plug component to the jack component.

In yet another aspect of this invention, a plug component for use with coaxial connector systems having plug components and threaded jack components is provided. This plug component includes a first electrical contact; a second electrical contact positioned around the first electrical contact, wherein the second electrical contact further includes a plurality of outwardly-biased protrusions; a body positioned around the second electrical contact, wherein the body is adapted to receive the outwardly-biased protrusions formed on the second electrical contact and form a ground plane therewith; at least one biasing member positioned around the body, wherein the biasing member provides axial linear force sufficient to urge the second electrical contact against a jack component for maintaining a ground plane therewith; and a locking device positioned around the biasing member and the body. The locking device further includes a substantially cylindrical member having a plurality of flared grasping arms formed at one end thereof; and a moveable collar for engaging the plurality of grasping arms and applying radial compressive force thereto for securely attaching the plug component to the threaded jack component.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1A:
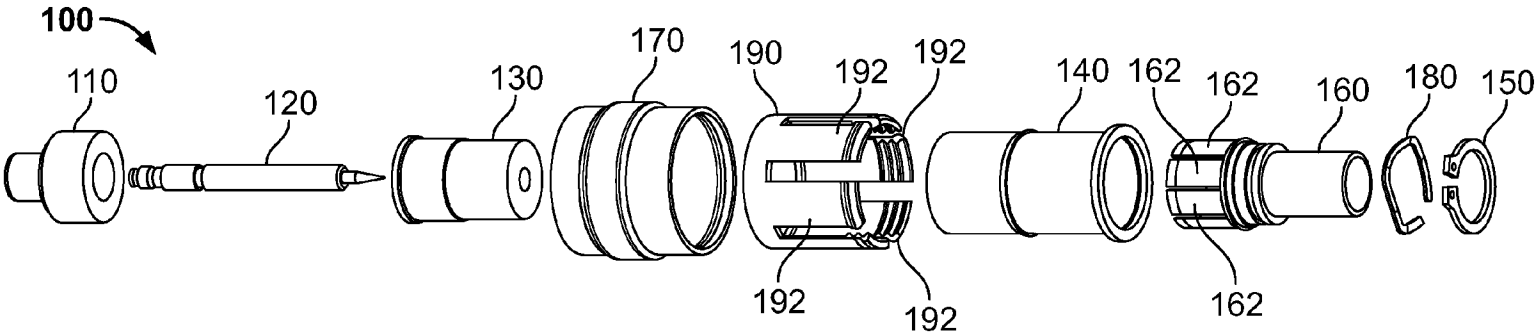
FIG. 1A is an exploded side view of a coaxial plug component in accordance with a first exemplary embodiment of the present invention.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to a manual, single motion, snap-on plug component for use with a connector system. As previously indicated, a first general embodiment of this invention provides a coaxial connector system; a second general embodiment of this invention provides a plug component for use with a coaxial connector system; and a third general embodiment of this invention also provides a plug component for use with a coaxial connector system. With reference now to the Figures, one or more specific embodiments of this invention shall be described in greater detail.

Figure 1B:
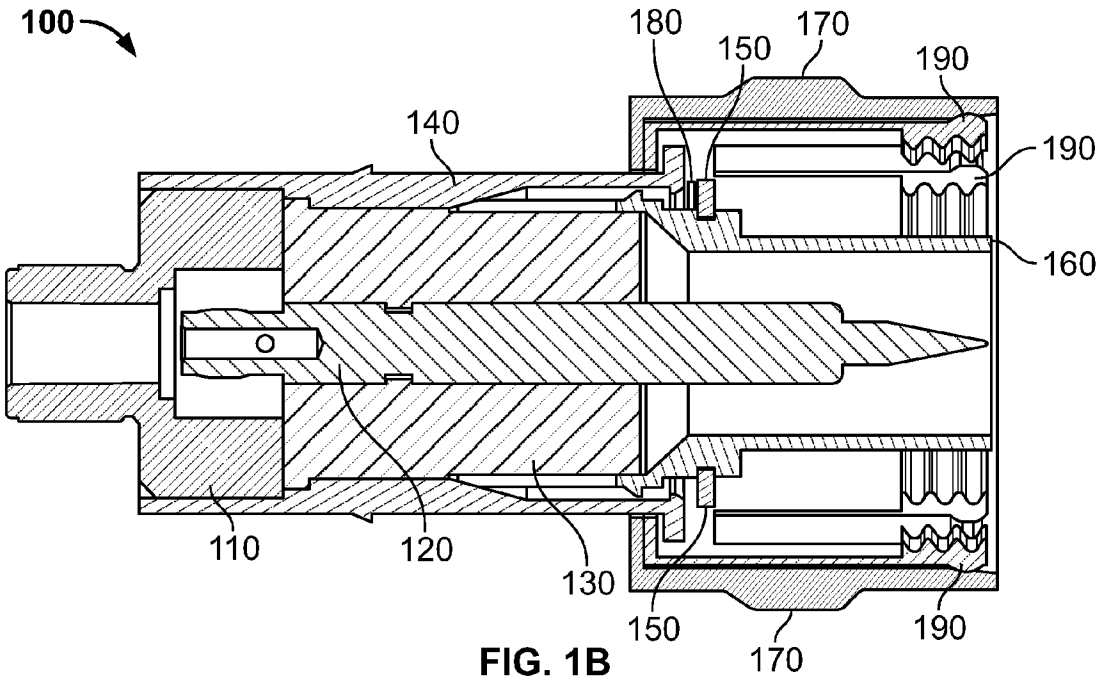
FIG. 1B is a cross-sectional side view of the assembled coaxial plug component of FIG. 1A.
Figure 1C:
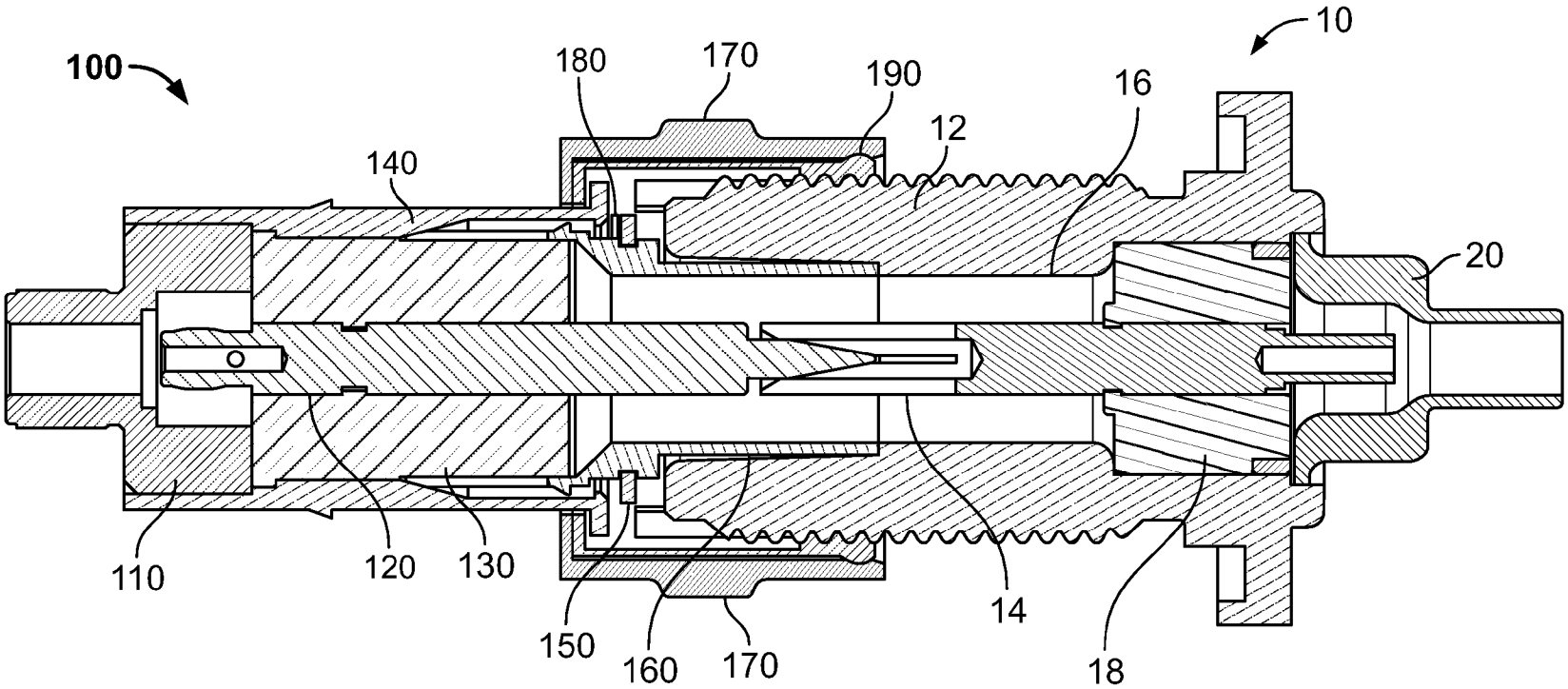
FIG. 1C is a cross-sectional side view of the plug component of FIG. 1A mated with a coaxial jack component.

With reference now to the Figures, FIGS. 1A-C provide various illustrative views of a connector system and plug component in accordance with a first exemplary embodiment of the present invention. In this embodiment, plug component 100 includes rear body 110, center pin contact 120, dielectric material 130, body 140, lock washer 150, outer contact 160, collar 170, spring 180, and locking member 190. One side of rear body 110 is adapted to receive center contact 120 and the other side of rear body 110 is crimped to the braid of a coaxial wire and secured with a ferrule. Crimping rear body 110 to the coaxial wire transfers the ground plane (see discussion below). Center contact 120 provides the signal path and is typically manufactured from conductive copper or other metals with properties similar to copper. Center contact 120 is typically soldered or crimped to a coaxial cable and is usually plated with a conductive material such as gold, silver, or nickel. The dielectric constant of dielectric material 130, which is typically plastic or a similar material, establishes consistent impedance throughout plug component 100 and provides a bearing surface for center contact 120. Cylindrical body 140 provides a mounting substrate for moveable collar 170 and locking member 190. Cylindrical outer contact 160 provides a ground plane connection for plug component 100 and in this embodiment, outer contact 160 includes plurality of spring arms 162. Spring arms 162 push radially outward against body 140 to transfer the ground plane through body 140 to the coaxial wire to which plug 100 is connected. Outer contact 160 is typically manufactured from a spring temper that includes phosphor bronze and/or beryllium copper and is plated with a conductive coating that may include gold, silver, nickel, and white bronze. As best shown in FIG. 1B, spring 180 and lock washer 150 are circumferentially disposed around outer contact 160 when plug component 100 is properly assembled.

FIG. 1C illustrates a connector system that includes plug component 100 and jack component 10. Jack component 10 includes a body having an outer threaded portion 12 and an inner, air-containing chamber 16, which houses center socket contact 14, dielectric material 18, and rear body 20. As shown in FIG. 1C, when plug component 100 and jack component 10 are mated, a plurality of flared grasping arms 192, which are formed at one end of locking member 190, snap into the individual threads of threaded portion 12. Collar 170 slides forward over locking member 190 for providing radial compressive force to grasping arms 192 and securely attaching plug component 100 to jack component 10. Spring 180, which may be a wave spring or other type of biasing member, is compressed when jack component 10 is inserted into plug component 100. In this embodiment, spring 180 acts directly against lock washer 150 and urges outer contact 160 forward and against the body of jack component 10 for forming an efficient ground plane therewith. In this manner, spring 180 simulates, in a linear manner, the radial torque force provided by a traditional threaded connector.

Figure 2A:
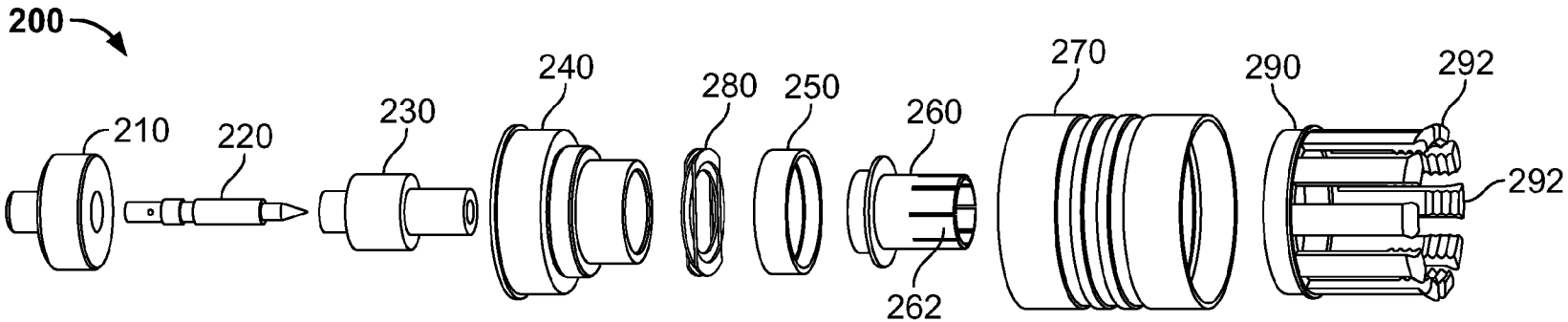
FIG. 2A is an exploded side view of a coaxial plug component in accordance with a second exemplary embodiment of the present invention.
Figure 2B:
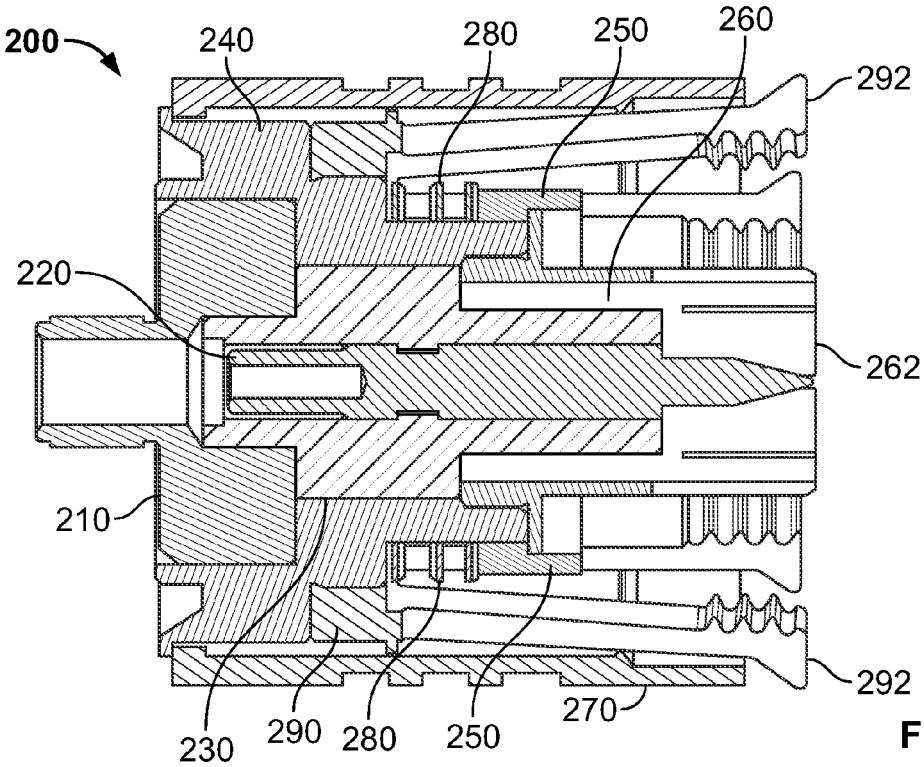
FIG. 2B is a cross-sectional side view of the assembled coaxial plug component of FIG. 2A showing the configuration of the plug component prior to the mating thereof with a coaxial jack component.
Figure 2C:
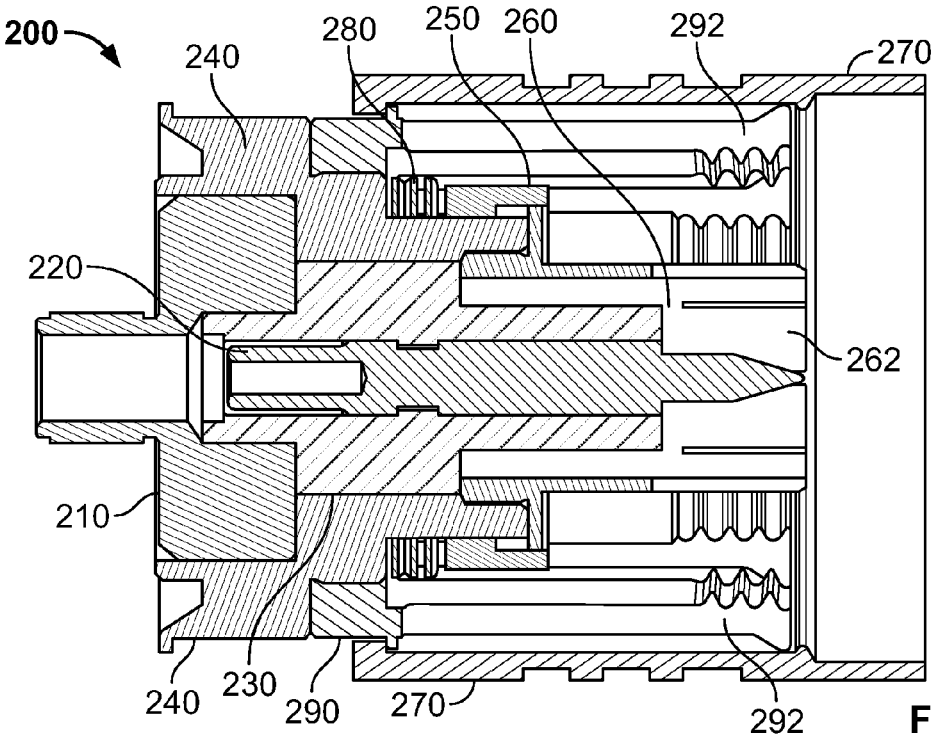
FIG. 2C is a cross-sectional side view of the assembled coaxial plug component of FIG. 2A showing the configuration of the plug component following the mating thereof with a coaxial jack component.

FIGS. 2A-D provide several views of a connector system and plug component in accordance with a second exemplary embodiment of the present invention. In this embodiment, plug component 200 includes rear body 210, center pin contact 220, dielectric material 230, body 240, retainer 250, outer contact 260, collar 270, biasing member or spring 280, and locking member 290. One side of rear body 210 is adapted to receive center contact 220 and the other side of rear body 210 is crimped to the braid of a coaxial wire and secured with a ferrule. Crimping rear body 210 to the coaxial wire transfers the ground plane. Center contact 220 provides the signal path and is typically manufactured from conductive copper or other metals with properties similar to copper. Center contact 220 is typically soldered or crimped to a coaxial cable and is usually plated with a conductive material such as gold, silver, or nickel. The dielectric constant of dielectric material 230, which is typically plastic or a similar material, establishes consistent impedance throughout plug component 200 and provides a bearing surface for center contact 260. Cylindrical body 240 provides a mounting substrate for moveable collar 270 and locking member 290. Cylindrical outer contact 260 provides the ground plane connection for plug component 200 and in this embodiment, outer contact 260 includes plurality of flared spring arms 262. Spring arms 262 push radially outward against the inner surface of jack 12 to transfer the ground plane through body 240 to the coaxial wire to which plug 200 is connected. Outer contact 260 is typically manufactured from a spring temper that includes phosphor bronze and/or beryllium copper and is plated with a conductive coating that may include gold, silver, nickel, and white bronze. As best shown in FIGS. 2B-C, spring 280 and retainer 250 are circumferentially disposed around body 240 when plug component 200 is properly assembled.

Figure 2D:
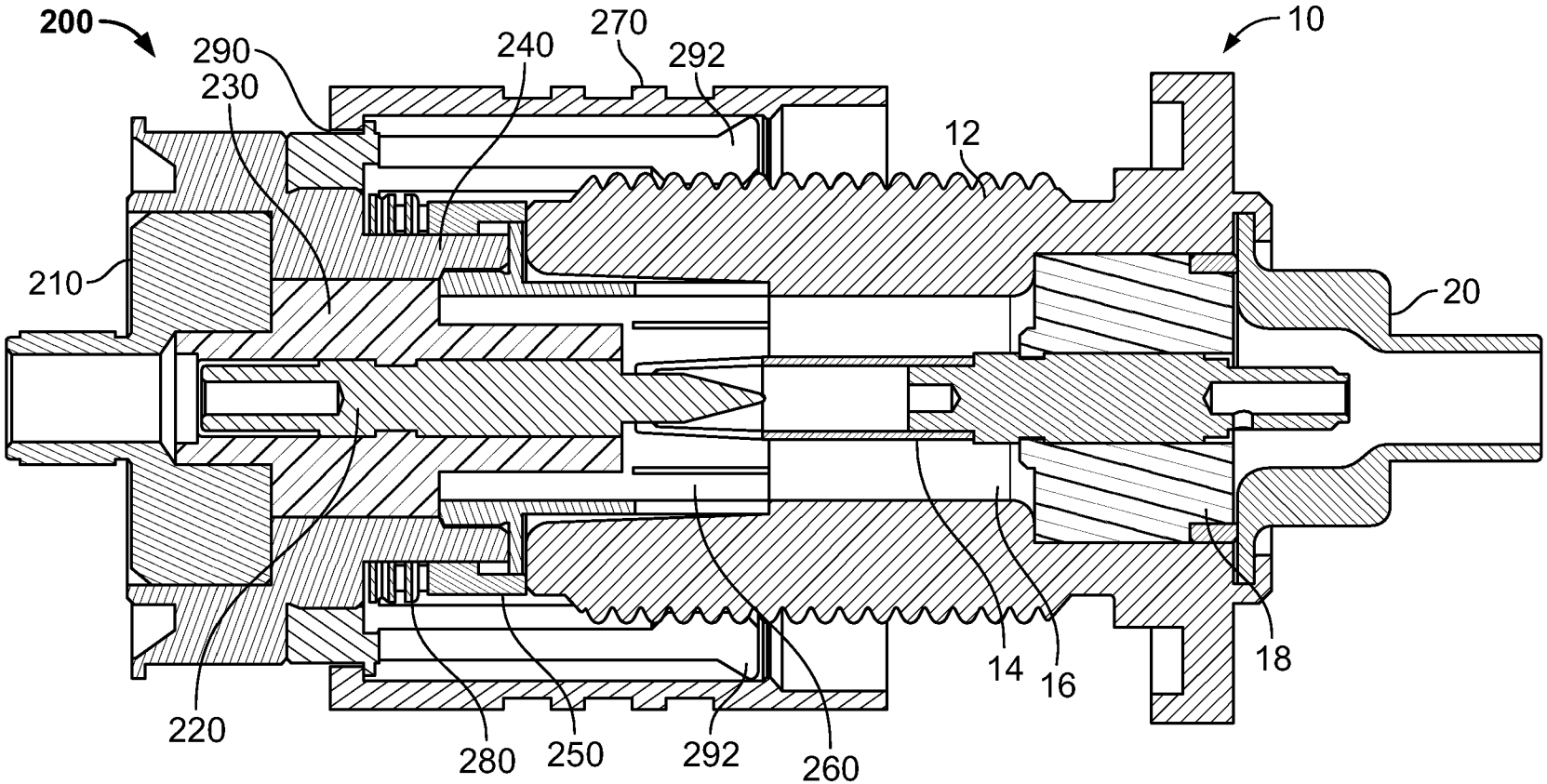
FIG. 2D is a cross-sectional side view of the plug component of FIG. 2A mated with a coaxial jack component.

FIG. 2D illustrates a connector system that includes plug component 200 and jack component 10. Jack component 10 includes a body having an outer threaded portion and an inner, air-containing chamber 16, which houses center socket contact 14, dielectric material 18, and rear body 20. As shown in FIG. 2D, when plug component 200 and jack component 10 are mated, a plurality of outwardly flared grasping arms 292, which are formed at one end of locking member 290 snap into the individual threads of threaded portion 12. Locking member 290 may be manufactured from phosphor bronze, beryllium copper, or other similar metals. Collar 270 moves or slides forward over locking member 290 for providing radial compressive force to grasping arms 292 and securely attaching plug component 200 to jack component 10. Spring 280, which may be a crest-to-crest wave spring or other type of biasing member, is compressed when jack component 10 is inserted into plug component 200 (see FIG. 2C). In this embodiment, spring 280 acts directly against retainer 250 and urges outer contact 260 forward and against the body of jack component 10 for forming an efficient ground plane therewith. In this manner, spring 280 simulates, in a linear manner, the radial torque force provided by a traditional threaded connector without actually involving the use of a torque wrench.

Figure 3A:
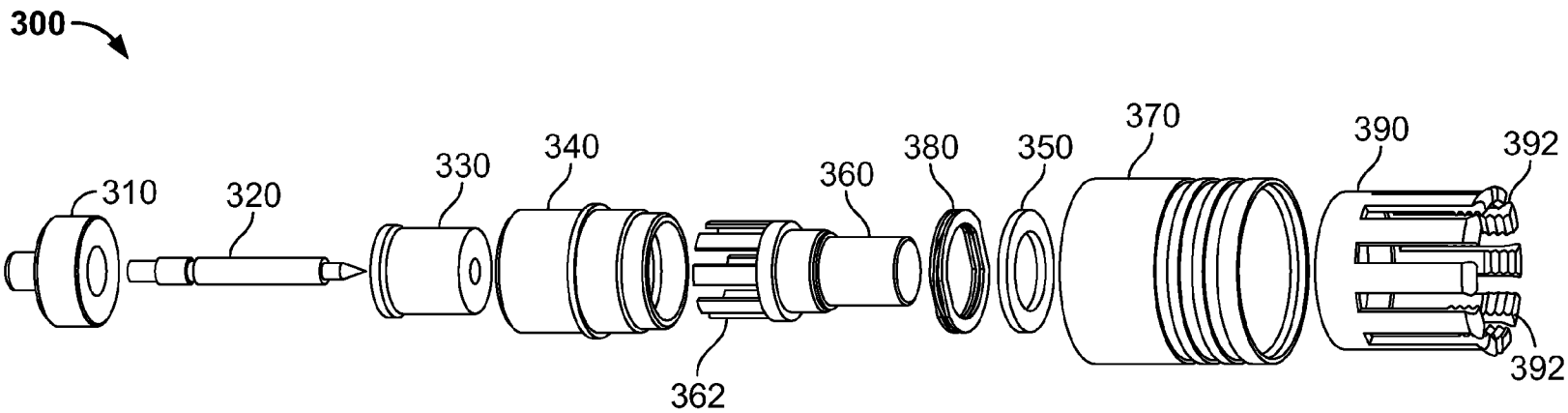
FIG. 3A is an exploded side view of a coaxial plug component in accordance with a third exemplary embodiment of the present invention.
Figure 3B:
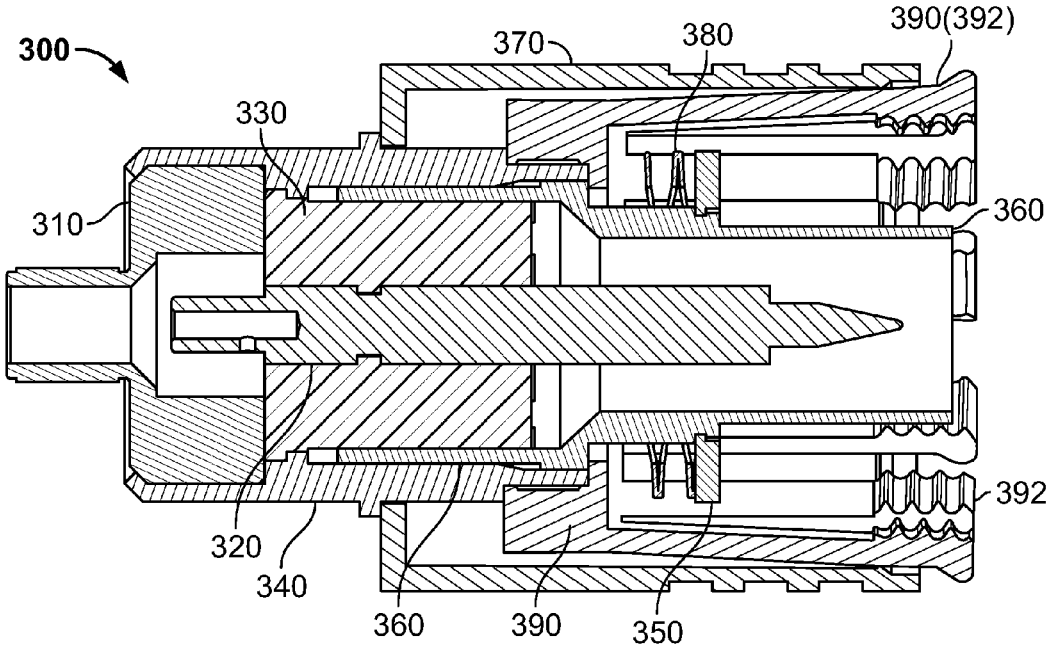
FIG. 3B is a cross-sectional side view of the assembled coaxial plug component of FIG. 3A showing the configuration of the plug component prior to the mating thereof with a coaxial jack component.
Figure 3C:
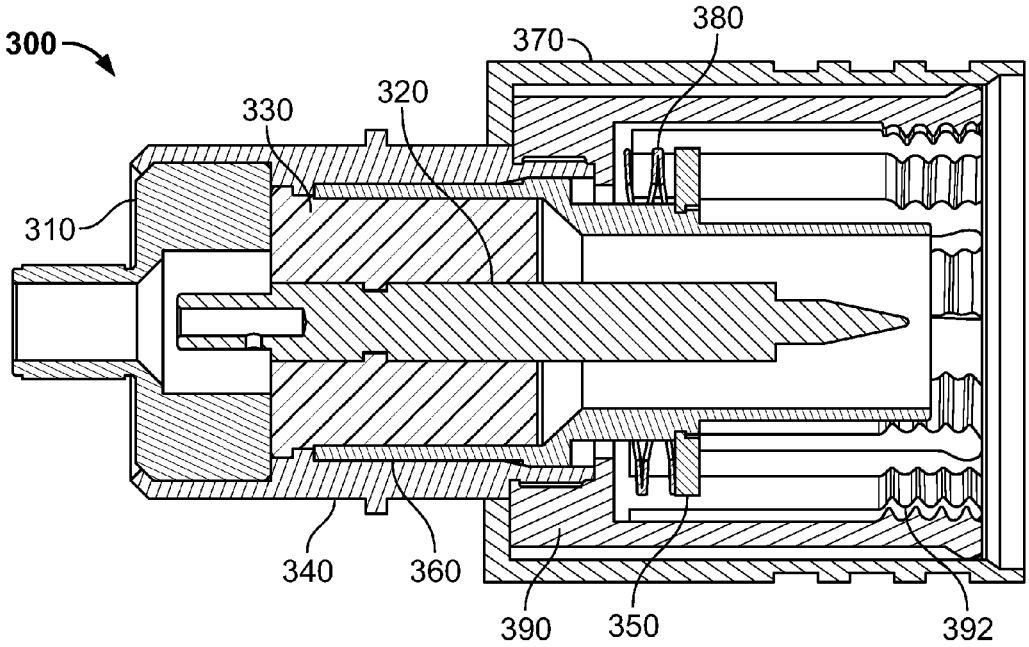
FIG. 3C is a cross-sectional side view of the assembled coaxial plug component of FIG. 3A showing the configuration of the plug component following the mating thereof with a coaxial jack component.

FIGS. 3A-D provide several views of a connector system and plug component in accordance with a third exemplary embodiment of the present invention. In this embodiment, plug component 300 includes rear body 310, center pin contact 320, dielectric material 330, body 340, retainer 350, outer contact 360, collar 370, biasing member or spring 380, and locking member 390. One side of rear body 310 is adapted to receive center contact 320 and the other side of rear body 310 is crimped to the braid of a coaxial wire and secured with a ferrule. Crimping rear body 310 to the coaxial wire transfers the ground plane. Center contact 320 provides the signal path and is typically manufactured from conductive copper or other metals with properties similar to copper. Center contact 320 is typically soldered or crimped to a coaxial cable and is usually plated with a conductive material such as gold, silver, or nickel. The dielectric constant of dielectric material 330, which is typically plastic or a similar material, establishes consistent impedance throughout plug component 300 and provides a bearing surface for center contact 320. Cylindrical body 340 provides a mounting substrate for moveable collar 370 and locking member 390. Cylindrical outer contact 360 provides the ground plane connection for plug component 300 and in this embodiment, outer contact 360 includes both a solid portion and a plurality of individual spring arms 362 that engage body 340 in a "floating" manner. The length of spring arms 362 allows outer contact 360 to make sufficient contact with body 340 and transmit the ground plane regardless of improper or less than ideal mating between plug component 300 and jack component 10. Outer contact 360 is typically manufactured from a spring temper that includes phosphor bronze and/or beryllium copper and is plated with a conductive coating that may include gold, silver, nickel, and/or white bronze. As best shown in FIGS. 3B-C, spring 380 and retainer 350 are circumferentially disposed around body 340 when plug component 300 is properly assembled.

Figure 3D:
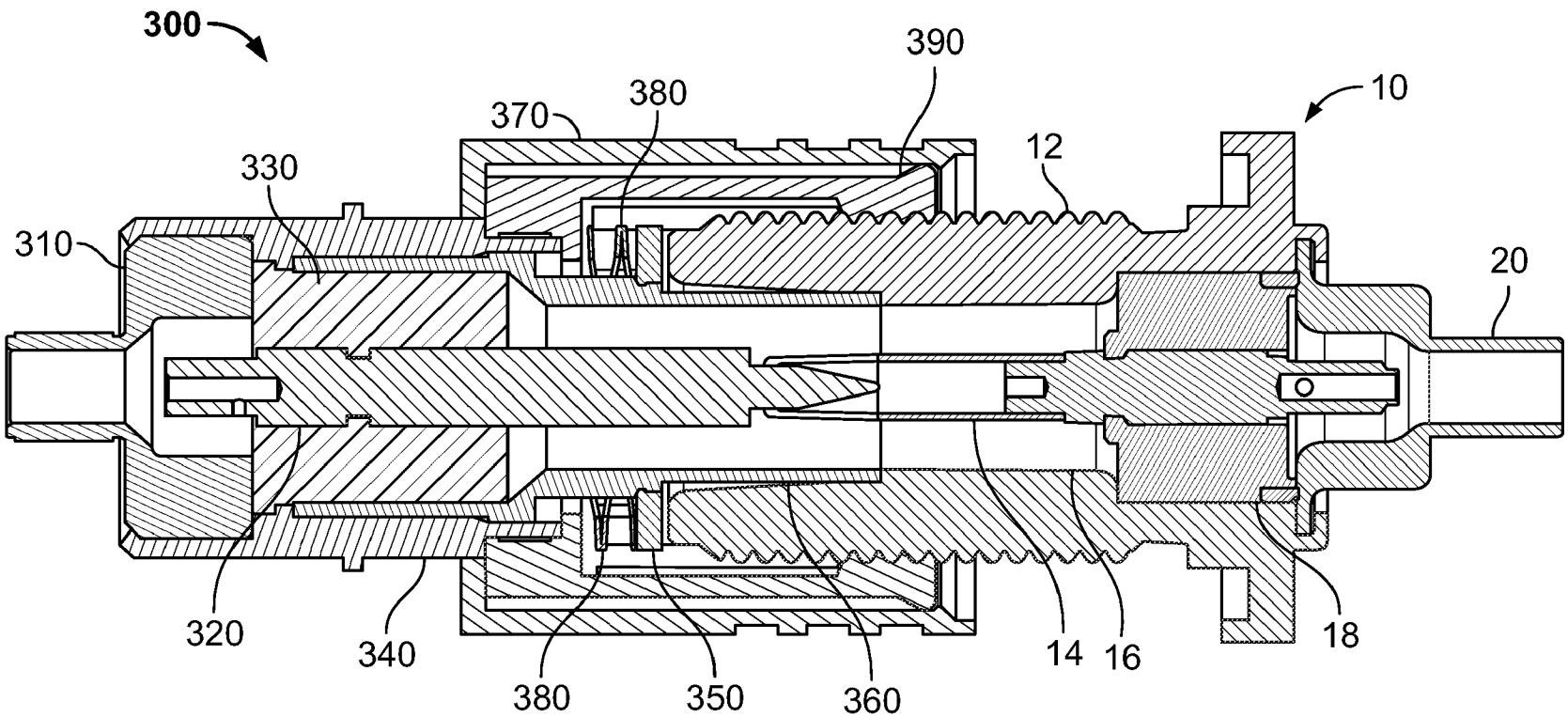
FIG. 3D is a cross-sectional side view of the plug component of FIG. 3A mated with a coaxial jack component.

FIG. 3D illustrates a connector system that includes plug component 300 and jack component 10. Jack component 10 includes a body having an outer threaded portion and an inner chamber 16, which houses center socket contact 14, dielectric material 18, and rear body 20. As shown in FIG. 3D, when plug component 300 and jack component 10 are mated, a plurality of outwardly flared grasping arms 392, which are formed at one end of locking member 390 snap into the individual threads of threaded portion 12. Locking member 390 may be manufactured from phosphor bronze, beryllium copper, or other similar metals. Collar 370 is then moved or slid forward over locking member 390 for providing radial compressive force to grasping arms 392 for securely attaching plug component 300 to jack component 10. Thus, locking member 390 and collar 370 cooperate with one another to provide a locking device. Spring 380, which may be a crest-to-crest wave spring or similar biasing device, is compressed when jack component 10 is inserted into plug component 300 (see FIG. 3C). In this embodiment, spring 380 acts directly against retainer 350 and urges outer contact 360 forward and against the body of jack component 10 for forming an efficient ground plane therewith. In this manner, spring 380 simulates, in a linear manner, the radial torque force provided by a traditional threaded connector without actually involving the use of a torque wrench.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A connector system, comprising:

(a) a jack component, wherein the jack component further includes:

(i) a first electrical contact; and (ii) a body for housing the first electrical contact, wherein the body further comprises a threaded area formed thereon; and (b) a plug component, wherein the plug component further includes:

(i) a second electrical contact adapted to engage the first electrical contact and establish a signal plane;

(ii) a third electrical contact circumferentially disposed around at least a portion of the second electrical contact, wherein the third electrical contact further includes a plurality of outwardly-biased protrusions formed at one end thereof;

(iii) a body circumferentially disposed around at least a portion of the third electrical contact, wherein the body is adapted to receive the outwardly-biased protrusions formed on the third electrical contact and form a ground plane;

(iv) at least one biasing member circumferentially disposed around the body, wherein the at least one biasing member provides axial force sufficient to urge the third electrical contact against the body of the jack component; and (v) a locking device circumferentially disposed around the biasing member and the body, wherein a portion of the locking device is adapted to mechanically engage the threaded area on the jack component for securely attaching the plug component to the jack component.

2. The connector system of claim 1, wherein the connector system is a coaxial connector system.

3. The connector system of claim 1, wherein the plug component further includes at least one dielectric material disposed around at least a portion of the second electrical contact.

4. The connector system of claim 1, wherein the first electrical contact further comprises a socket and wherein the second electrical contact further comprises a pin, and wherein the socket and pin cooperate to transmit the signal plane between the jack component and the plug component.

5. The connector system of claim 1, wherein in the plurality of outwardly-biased protrusions on the third electrical contact are adapted to frictionally engage an inner portion of the body.

6. The connector system of claim 1, wherein the at least one biasing member further comprises a crest-to-crest wave spring.

7. The connector system of claim 1, wherein the locking device further comprises a substantially cylindrical member having a plurality of grasping arms formed at one end thereof; and a slidable collar for engaging the plurality of grasping arms and applying compressive radial force thereto for securely attaching the plug component to the jack component.

8. The connector system of claim 1, wherein the third contact is manufactured from at least one of phosphor bronze and beryllium copper and further comprises a conductive coating that includes at least one of gold, silver, nickel, and white bronze.

9. A plug component for use with connector systems having a plug component and a threaded jack component, comprising:

(a) a first electrical contact;

(b) a second electrical contact circumferentially disposed around at least a portion of the first electrical contact, wherein the second electrical contact further includes a plurality of outwardly-biased protrusions formed at one end thereof;

(c) a body circumferentially disposed around at least a portion of the second electrical contact, wherein the body is adapted to receive the outwardly-biased protrusions formed on the second electrical contact and form a ground plane therewith;

(d) at least one biasing member circumferentially disposed around the body, wherein the at least one biasing member provides linear force sufficient to urge the second electrical contact against a jack component for maintaining a ground plane therewith; and (e) a locking device circumferentially disposed around the biasing member and the body, wherein a portion of the locking device is adapted to mechanically engage the threaded area on the jack component for securely attaching the plug component to the jack component.

10. The plug component of claim 9, further including at least one dielectric material disposed around at least a portion of the first contact.

11. The plug component of claim 9, wherein the plug component is adapted for use with coaxial connector systems.

12. The plug component of claim 9, wherein the plurality of outwardly-biased protrusions on the second electrical contact are adapted to frictionally engage an inner portion of the body.

13. The plug component of claim 9, wherein the at least one biasing member further is a crest-to-crest wave spring or a spiral spring.

14. The plug component of claim 9, wherein the locking device further comprises a substantially cylindrical member having a plurality of grasping arms formed at one end thereof; and a slidable collar for engaging the plurality of grasping arms and applying compressive radial force thereto for securely attaching the plug component to a jack component.

15. The plug component of claim 9, wherein the second contact is manufactured from at least one of phosphor bronze and beryllium copper and further comprises a conductive coating that includes at least one of gold, silver, nickel, and white bronze.

16. A plug component for use with connector systems having a plug component and a threaded jack component, comprising:

(a) a first electrical contact;

(b) a second electrical contact disposed around at least a portion of the first electrical contact, wherein the second electrical contact further includes a plurality of outwardly-biased protrusions formed at one end thereof;

(c) a body for housing at least a portion of the second electrical contact, wherein the body is adapted to receive the outwardly-biased protrusions formed on the second electrical contact and form a ground plane therewith;

(d) at least one biasing member disposed around the body, wherein the at least one biasing member provides linear force sufficient to urge the second electrical contact against a jack component for maintaining a ground plane therewith; and (e) a locking device disposed around the body, wherein the locking device further includes:

(i) a substantially cylindrical member having a plurality of outwardly flared grasping arms formed at one end thereof; and (ii) a slidable collar for engaging the plurality of grasping arms and applying radial compressive force thereto for securing the plug component to the threaded jack component.

17. The plug component of claim 16, further including at least one dielectric material disposed around at least a portion of the first contact.

18. The plug component of claim 16, wherein the plurality of outwardly-biased protrusions on the second electrical contact are adapted to frictionally engage an inner portion of the body.

19. The plug component of claim 16, wherein the at least one biasing member further comprises a crest-to-crest wave spring.

20. The plug component of claim 16, wherein the second contact is manufactured from at least one of phosphor bronze and beryllium copper and further comprises a conductive coating that includes at least one of gold, silver, nickel, and white bronze.

* * * * *